United States Patent [19]

Okamoto

[11] Patent Number: 4,608,777

[45] Date of Patent: Sep. 2, 1986

[54] SLIDING DOOR APPARATUS

[75] Inventor: Hiroshi Okamoto, Funabashi, Japan

[73] Assignee: Kawasaki Jukogyo Kabushiki Kaisha, Kobe, Japan

[21] Appl. No.: 608,435

[22] Filed: May 9, 1984

[30] Foreign Application Priority Data

May 11, 1983 [JP] Japan ..... 58-83241

[51] Int. Cl.[4] ..... E05D 15/10

[52] U.S. Cl. ..... 49/214; 49/225; 49/450

[58] Field of Search ..... 49/209, 213, 214, 218, 49/219, 225, 449, 450

[56] References Cited

U.S. PATENT DOCUMENTS

| | | | |
|---|---|---|---|
| 2,511,425 | 6/1950 | Beauchamp | 49/218 X |
| 2,591,412 | 4/1952 | Ditchfield | 49/209 |
| 2,937,416 | 5/1960 | Hiers | 49/449 X |
| 3,324,595 | 6/1967 | Loomis | 49/450 X |
| 3,786,599 | 1/1974 | Galbarzyk et al. | 49/219 X |

FOREIGN PATENT DOCUMENTS 57-165571 4/1981 Japan .

*Primary Examiner*—Kenneth Downey

*Attorney, Agent, or Firm*—Marshall, O'Toole, Gerstein, Murray & Bicknell

[57] ABSTRACT

This disclosure relates to a door closing apparatus for use primarily with a railway car including a side wall, a door opening formed in the side wall, an upper rail on the wall adjacent the upper portion of the opening and a lower rail on the side wall adjacent the lower portion of the opening, and a door mounted for movement on the rails and movable between open and closed positions relative to the opening. The apparatus comprises lower rollers adjacent the bottom of the door for supporting the door on the lower rail, and upper rollers adjacent the top of the door for engagement with the upper rail, the rails having curved portions enabling the door to be pushed into the opening. A handle bar is pivotably mounted on the door and a lock shaft is movably mounted on the door and linked to the handle. A strike is mounted on the side wall adjacent the lock shaft when said door is in said closed position, and pivotal movement of the handle bar causes the lock shaft to move into the strike. The shaft and the strike have cooperating wedging surfaces thereon for forcing the door laterally into the opening as the shaft is moved into the strike. An auxiliary door roller is preferably provided adjacent the top of the door and helps to control movement of the door. A handle bar lock is mounted on the door adjacent the handle bar, and it is operable to automatically engage and hold the handle bar when the handle bar is moved to force the lock shaft into the strike.

14 Claims, 27 Drawing Figures

SLIDING DOOR APPARATUS

The present invention relates to a push-in type sliding door and a locking mechanism for such a door, of the type that is mainly used in vehicles such as railway cars.

BACKGROUND OF THE INVENTION

A push-in type sliding door apparatus is one wherein the sliding doors are flush, on the interior side, with the fixed wall of the vehicle when the doors are in their closed position. During opening movement, each door is pulled away from the fixed wall of the vehicle by a certain distance to avoid either the fixed wall or another closed door, and then it is pulled to the open position where it is over the outer side of the fixed wall or the other door.

In one such conventional opening and closing mechanism, as exemplified by Japanese Patent Publication No. SHO. 57-59095, the sliding doors are shifted by a required distance outwardly away from the vehicle's wall by means of turning rails which are separately provided in addition to the travel rails. In this mechanism, each sliding door is provided with shafts and crank arms, and the door is pulled outwardly by the length of the upper and the lower crank arms to open it. This structure requires two sets of opening and closing mechanisms, and the door cannot be easily handled by an operator.

On the other hand, the mechanism disclosed by Japan Patent Provisional Publication No. SHO. 57-165571 improved on the above-mentioned mechanism of a crank shaft, crank arms and arm rollers to reduce the required structure to one set of the mechanism per door, and with some arrangements of the rails and door rollers, the pushing-in and pulling-out operations are effected by turning a crank shaft. The mechanism, however, has some disadvantages including that the mechanism is complex and cannot be fabricated with ease, and that the two-stage construction of the upper horizontal door roller reduces the effective height of the opening.

It is a general object of the present invention to eliminate such disadvantages of the prior art mechanisms and to provide a push-in type sliding door apparatus and a locking mechanism therefor that are simple in construction and ensure reliable opening and closing operations.

SUMMARY OF THE INVENTION

Apparatus in accordance with this invention is for use primarily with a railway car including a side wall, a door opening formed in the side wall, an upper rail on the wall adjacent the upper portion of the opening and a lower rail on the side wall adjacent the lower portion of the opening, and a door mounted for movement on the rails and movable between open and closed positions relative to said opening. The apparatus comprises lower rollers adjacent the bottom of the door for supporting the door on the lower rail, and upper rollers adjacent the top of the door for engagement with the upper rail, the rails having curved portions enabling the door to be pushed into the opening. A handle bar is pivotably mounted on the door and a lock shaft is movably mounted on the door and linked to the handle. A strike is mounted on the side wall adjacent the lock shaft when said door is in said closed position, and pivotal movement of the handle bar causes the lock shaft to move into the strike. The shaft and the strike have cooperating wedging means thereon for forcing the door laterally into the opening as the shaft is moved into the strike. An auxiliary door roller is preferably provided adjacent the top of the door and helps to control movement of the door. A handle bar lock is mounted on the door adjacent the handle bar, and it is operable to automatically engage and hold the handle bar when the handle bar is moved to force the lock shaft into the strike.

BRIEF DESCRIPTION OF THE DRAWINGS

The construction and operation of the present invention will now be explained with reference to a preferred embodiment illustrated in the accompanying drawings, in which.

DETAILED DESCRIPTION OF THE DRAWINGS

Figure 1:
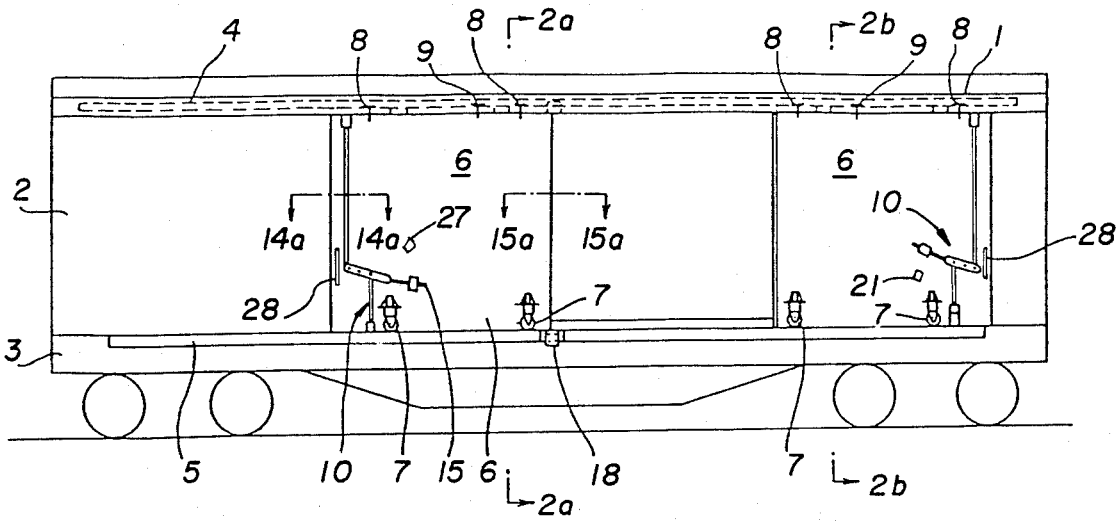
FIG. 1 is a side view of a covered railway car equipped with a sliding door apparatus according to the present invention.
Figure 2A:
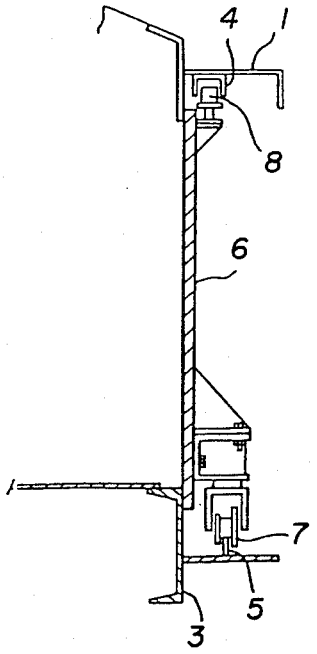
FIGS. 2*a* and 2*b* are cross-sectional views of the sliding doors taken along the lines 2*a*—2*a* and 2*b*—2*b* of FIG. 1, respectively.
Figure 2B:
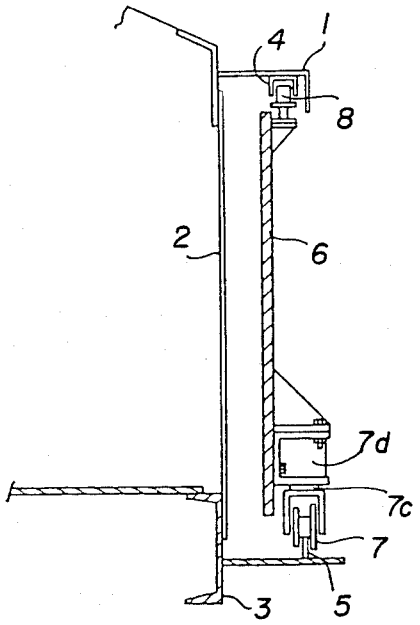

FIG. 1 shows a vehicle, more specifically a railway car, equipped with a push-in type sliding door apparatus according to the present invention. The apparatus includes a left-hand side door 6 which is in the closed position and a right-hand side door 6 which is in the open position. Each push-in type sliding door 6 is held and guided, at the upper portion thereof, by the horizontal door rollers 8 (FIG. 2*a*) positioned in the upper rail 4 installed on the head jamb 1, and at the lower portion thereof, by two vertical door rollers 7 positioned on the lower rail 5 provided on the outer face of the side sill 3 of the car. On the pull-to-open side of the sliding door, one set of a push-in mechanism 10 is provided, and the lock, as will be explained later, can be engaged or disengaged with the strikes by operating the handle bar 15.

With reference to FIGS. *2a* and *2b*, the horizontal door roller 8 at the upper end of the door turns in the groove of the upper rail 4, and the vertical door roller 7 at the bottom of the door is guided by the flanges of the roller 7 to roll on the lower rail 5. As shown in FIG. *2a*, the sliding door 6, in the closed position, takes a pushed-in position in the vehicle body and is tight against the outside of the vertical wall 2 of the car. In the open position shown in FIG. *2b*, the door moves along the fixed wall 2 of the vehicle body at a certain distance away from the wall. Each vertical door roller 7 can be rotated around a vertical axis as will be described.

FIGS. *3a* and *3b* show left and right sliding doors 6 and the installation of their upper and lower door rollers and stoppers. Two sets of vertical door rollers 7 are mounted on the lower edge of each sliding door to support and guide the sliding door. Two horizontal door rollers 8 are mounted on the upper edge of each sliding door, and in addition to them, at least one auxiliary horizontal door roller 9 is provided. Although the action of the auxiliary horizontal door roller 9 will be explained later, two arrangements are possible; one is, as shown in FIG. *3a*, to install it between the two horizontal door rollers 8 with their axes all aligned in a single plane, and the other is, as shown in FIG. *3b*, to install the auxiliary horizontal door roller 9 closely beside the horizontal door roller 8 in order to clamp a downward flange of the upper rail 4 between them. FIGS. *2a* and *2b* show the construction of FIG. *3a*. The stoppers 17 are provided at two points along the pull-to-close vertical side edge 18 of the door and at two points along the top of the sliding door. Stoppers may also be provided at any points along the circumference of the sliding door, as required.

FIGS. *4a*, *4b* and *4c* show the construction of the vertical door rollers 7 at the bottom of the door. These drawings are identical to those contained in the Japan Provisional Publication No. SHO. 57-165571.

Each roller 7 is also rotatable around a vertical axis formed by a vertical pin *7c* that rotates in a housing *7d*. The side flanges have different heights *7a*, *7b* (FIG. *4b*). The rollers 7 engage the lower rails 5 so that, for one roller 7 of each door the larger flange is on the outside and for the other roller 7 of the door the larger flange is on the inside. With this arrangement of the flanges of the door rollers 7, as will be explained later, the path of the door roller is selected. In the vertical door roller 7 installed adjacent the pull-to-close side 18 of the sliding door, the height of the flange closer to the vehicle body is the lower flange *7b*, as shown in FIG. *4b*. In the vertical door roller installed on the opposite or pull-to-open side of the sliding door, the height of the flange closer to the vehicle body is the higher *7a*, as shown in FIG. *4c*.

Figure 5A:
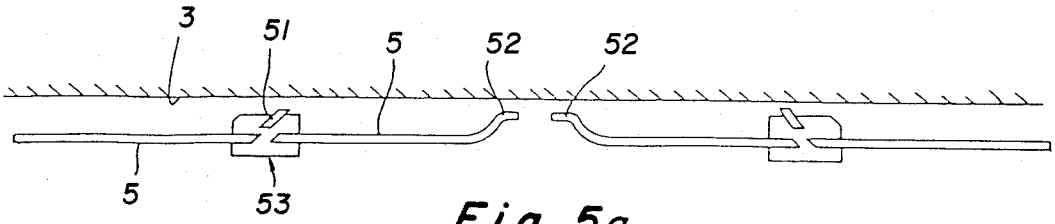
FIG. 5*a* is a plan view of the lower rails and curved rails.
Figure 5C:
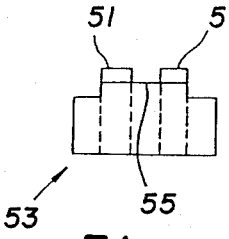
FIG. 5*c* is a sectional view taken along the line 5*c*—5*c* in FIG. 5*b;*
Figure 5B:
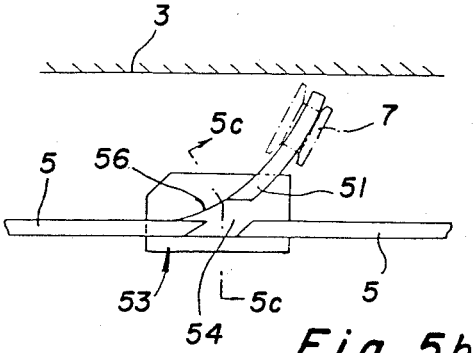
FIG. 5*b* is a fragmentary detailed view of a portion of the structure of FIG. 5(*a*)

FIG. 5 shows the lower rail 5 that engages the lower vertical door rollers 7, and the rail corresponds to the construction of the sliding doors shown in FIG. 1. The lower rail 5 is mounted at a required distance away from the side sill 3 to allow space for movement of the door 6, and the lower rail is angled at branch points 51 and 52 corresponding to the locations of the vertical door rollers 7 when the sliding door 6 is closed. The inner end point 52 of the lower rail 5 is bent to form a smooth curve towards the side sill 3 so that the inner end of the sliding door 6 can be smoothly pushed into the closed position. The other branch point rail 51 branches out from the main lower rail 5, and extends at an angle in the direction of the pushing-in of the sliding door 6 in a smooth curve, as shown in FIG. *5b*. The angle of the branch point rail 51 is substantially equal to the angle of the curve at the point 52. The lower rail 5 adjacent the point 51 includes a junction 53 arranged as shown in FIGS. *5b* and *5c*, which is provided with a flange path 54 that allows the outer smaller flange of the vertical door roller 7 to move through the junction 53. The junction 53 further includes a raised portion 55, the edge 56 of which engages the larger flange of the roller 7 and forcibly guides the door roller to the branch 51 when the larger flange comes into contact with it (see FIG. *5c*). FIG. *5b* illustrates the branching movement of the vertical door roller 7 which is mounted on the outer or pull-to-open side of the door, due to the action of the large flange engaging this raised portion 55.

Figure 4A:
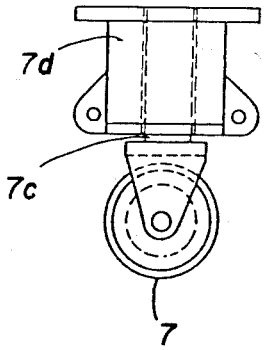
FIGS. 4*a*, 4*b* and 4*c* are enlarged views of the lower vertical door rollers, FIG. 4*a* being a side view of a roller adjacent the rear of the door, and FIGS. 4*b* and 4*c* being end views of the two rollers of each door.
Figure 4B:
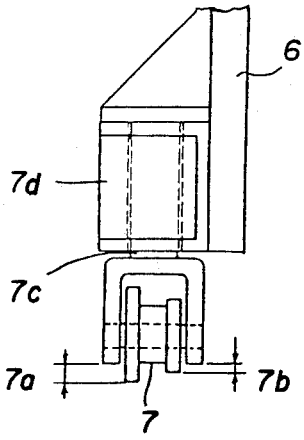
Figure 4C:
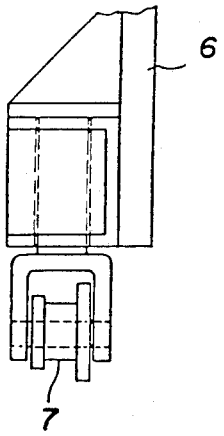
Figure 6A:
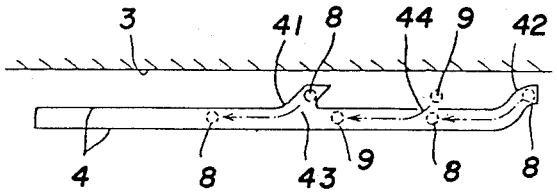
FIGS. 6*a* and 6*b* are plan views of the upper tails and curved rails.
Figure 6B:
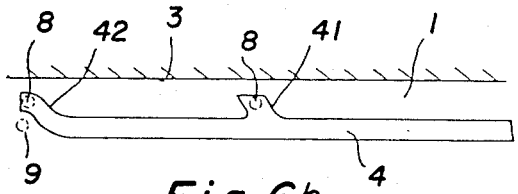
Figure 6C:
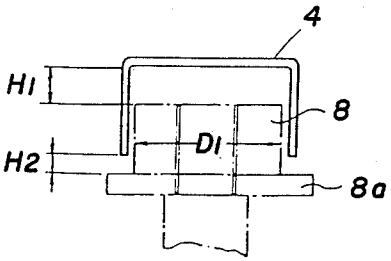
FIGS. 6*c* and 6*d* are sectional views of the upper rails.
Figure 6D:
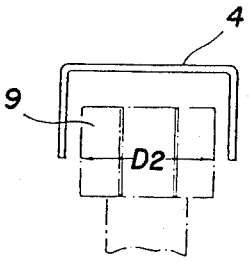

FIGS. *6a*–*6d* show the shape of the upper rails 4 which engage the upper horizontal door rollers 8, and similar to the construction in FIG. 5, it corresponds to the arrangement of the sliding doors shown in FIG. 1. The upper rail 4 has an inverted channel shape and is installed on the head jamb 1 of the car, at a required space or distance from the vehicle body to allow movement of the door, similar to the lower rail. The upper rail 4 is also shaped to provide an upper branch rail point 41 and an upper rail end point 42 at locations corresponding to the locations of the horizontal door rollers 8 when the sliding door is closed, as shown in FIGS. *6a* and *6b*. The upper rail end point 42 is bent in a smooth curve towards the vehicle body similar to the lower point 52 so that the sliding door 6 can be smoothly pushed into the closed position. The upper branch rail point 41 is branched out of the upper rail main branch 43 and extends in the direction of pushing-in of the sliding door 6, again in a smooth shape. Because the upper rail branch 43 is branched at the point 41 as shown in FIGS. *6a* and *6b*, when the right-hand horizontal door roller 8 provided adjacent the pull-to-close side 18 of the sliding door passes the branch 41, this roller 8 may tend to move into the branch way 41 instead of moving straight in the branch 43. The auxiliary horizontal door roller 9 is provided to prevent this occurrence, and there are two possible arrangements; in one arrangement shown in FIGS. *3a* and *6a*, the auxiliary horizontal door roller 9 is installed between the two upper horizontal door rollers 8 with their axes all aligned in a single plane; in the other arrangement, as shown in FIGS. *3b* and *6b*, the auxiliary door roller is installed laterally beside the horizontal door roller 8 on the pull-to-close side 18 of the door in order to clamp the outer downward flange of the upper rail 4 between them. In each arrangement, the entry of the horizontal door roller 8 on the pull-to-close side 18 into the upper branch rail 41 is prevented. In the arrangement of FIG. *6a*, a notch 44 is provided in the inner flange of the upper rail 4 at a point corresponding to the location of the roller 9 when the door is at the closed position so that the auxiliary door roller 9 does not prevent the pushing-in of the sliding door. In order to prevent the horizontal door rollers 8 from passing through the notch 44, the width of the notch 44 is made smaller than the diameter $D_1$ (see FIG. 6c) of the horizontal door roller 8, and greater than the diameter $D_2$ (FIG. 6d) of the auxiliary door roller 9. Next, in order to prevent the sliding door 6 from lifting up, due to any reason, and the lower vertical door rollers 7 from coming off the lower rail 5, during opening or closing operation of the door, the normal gap between the upper rail 4 and the horizontal door rollers 8 is restricted. As a means to achieve this restriction, as shown in FIG. 6c and FIG. 6d, the distance $H_1$ between the web or ceiling of the upper rail 4 and the top side of the horizontal door roller 8, or the distance $H_2$ between the bottom end of the flanges of the upper rail 4 and the top of the flange 8a provided on the horizontal door roller 8 is made smaller than the flange height 7b (FIG. 4b) of the lower vertical door roller 7. In this way, the sliding door can be prevented from coming off the rail 5 due to lift-up. The arrangement of the upper rail 4 and the lower rail 5 is not limited to that of the preferred embodiment shown in the drawings. The rails may take the form disclosed in Japan Provisional Publication No. SHO. 57-165571.

Figure 7B:
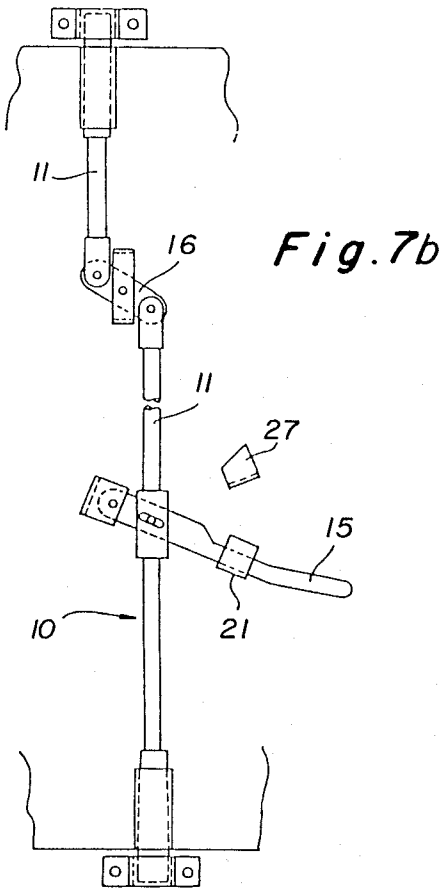
FIGS. 7*a* and 7*b* are diagrams illustrating the locking mechanism.
Figure 7A:
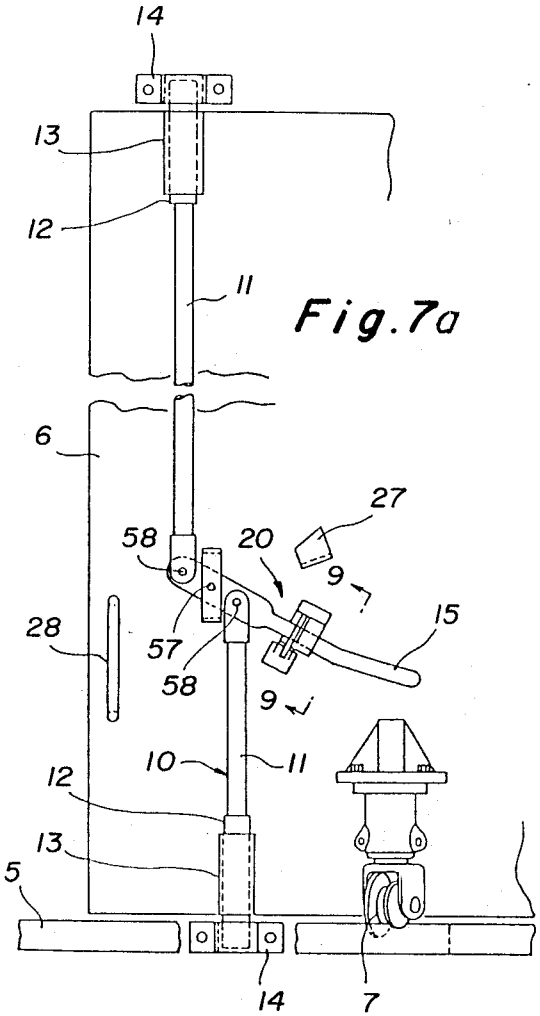

FIGS. 7a and 7b show the push-in mechanism. The push-in mechanism 10 consists of upper and lower lock shafts 11, a lock 12 installed on the outer end of each lock shaft 11, and a lever or handle bar 15 connected to the lock shafts 11 to insert or withdraw the locks by a turning operation. In the mechanism shown in FIG. 7a, the handle is pivotally connected by a pin 57 to the door 6 and pivotally connected by pins 58 to the two shafts 11 on opposite sides of the pin 57. Thus the shafts 11 are moved in opposite directions when the handle 15 is pivoted.

Figure 8:
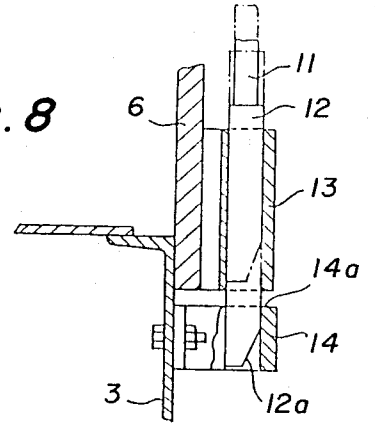
FIG. 8 is an enlarged fragmentary view further illustrating a part of the locking mechanism.

FIG. 8 shows the sliding door in the closed position, and the lock 12 is in a strike 14 mounted on the sill 3. The position shown by dash-dot lines indicates the unlocked position of the lock 12. The lock can be released or unlocked by turning the handle bar 15 shown in FIG. 7a upwardly. As the operation of the handle bar is normally made by a person standing on the ground, it is desirable to locate the handle bar at a low elevation. In FIG. 7a, of the two lock shafts 11, the upper lock shaft 11 is relatively long, and the push-in mechanism constantly acts to move open due to its own weight. Accordingly, the handle bar requires a locking mechanism 20 which will be explained later, and the handle bar is received in a handle bar receiver 27 when the lock is released.

The generation of the pushing-in force will now be explained. When a sliding door 6 in open position is pulled toward the center of the car to close it by gripping and pulling the push rod 28, or a similar handle, the sliding door will move along the upper and the lower rails, and eventually the inner or pull-to-close side 18 of the door will be guided by the upper rail end point 42 and the lower rail end point 52 and the door will be pushed against the vehicle body. The outer or pull-to-open side adjacent the push-in mechanisn 10 cannot be fully pushed into the position closed by mere branching of the upper and the lower door rollers at the branch points 41 and 51. Then, as shown in FIG. 8, a bevel or slope 12a provided at the outer end of each lock 12 of the push-in mechanism is located to engage an edge of the adjacent strike 14, and the locks 12 will be forced into the strikes 14 by turning the handle bar 15. At the same time, a lateral force which pushes the sliding door 6 laterally towards the vehicle body will be generated by the wedging action between said slopes 12a and strikes 14. The slope 12a could be provided on the edge 14a of the strike instead of on the lock 12, and the effect is the same.

FIG. 7b shows another embodiment of the lock shafts and the handle of the push-in mechanism. The relation of the lengths of the upper and lower lock shafts 11 is the reverse of that of FIG. 7a, and the shafts are connected by a linkage 16. The mechanism is essentially the same as that of FIG. 7a except the handle bar connection is a little different. The handle 15 is connected to the lower shaft 11 by a pin-in-slot connection. In this construction, as the locks are constantly urged to the locked position by the weight of the longer shaft 11, no locking mechanism is required.

Figure 9:
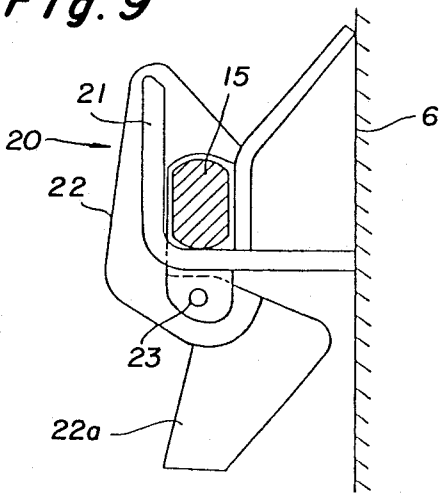
FIG. 9 is a sectional view of the upper portion of the handle bar, taken along the line 9—9 of FIG. 7*a;*

FIG. 9 shows a locking mechanism 20 of the push-in mechanism, which consists of a handle bar receiver 21 and a handle bar lock 22. The lock 22 is pivotally mounted by a pin 23 to a downward extension of receiver 21. The receiver 21 is secured to the door 6, and receives the bar 15 when the sliding door is in the closed position. The top portion of the handle bar lock 22 is shaped into a hook, and under the action of the lower weight 22a formed on the lock 22, it pivots and blocks by its own weight the opening of the handle bar receiver 21, to thereby lock the handle bar 15 in the handle bar receiver 21 and prevent the handle bar from lifting off. When the handle bar 15 is to be released, the weight 22a is pushed or the hook-shaped top of the lock 22 is pulled. The locking mechanism can thus be unlocked with ease. When the handle bar 15 is to be secured in the locking mechanism 20, the shape of the upper edge of the handle bar lock 22, as arranged with a slope, as shown in FIG. 9, will allow the handle bar lock 22 to be pushed to be cammed open by the handle bar 15. Once the handle bar is located in the proper position inside the handle bar receiver 21, the handle bar will be locked instantly by the weight of the lock itself.

Figure 3A:
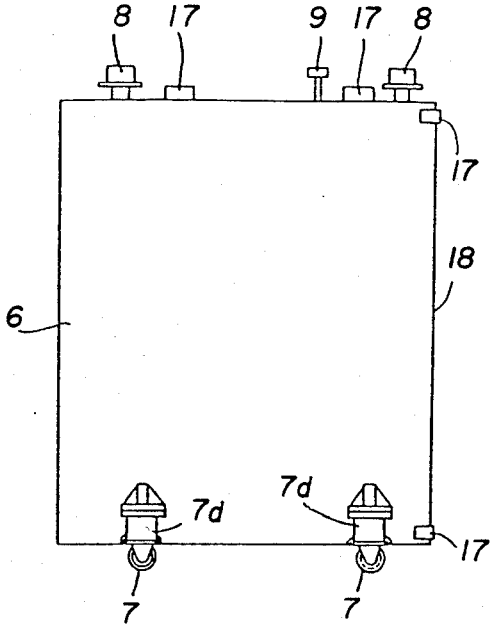
FIGS. 3*a* and 3*b* are side views illustrating the left-hand side sliding door and the right-hand side sliding door of FIG. 1, respectively.
Figure 3B:
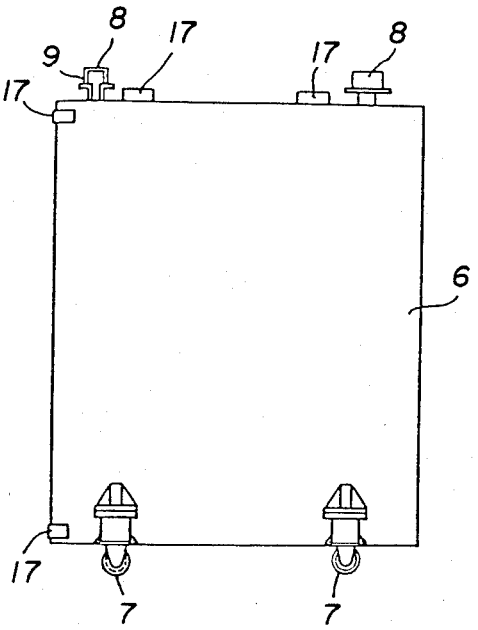
Figure 10:
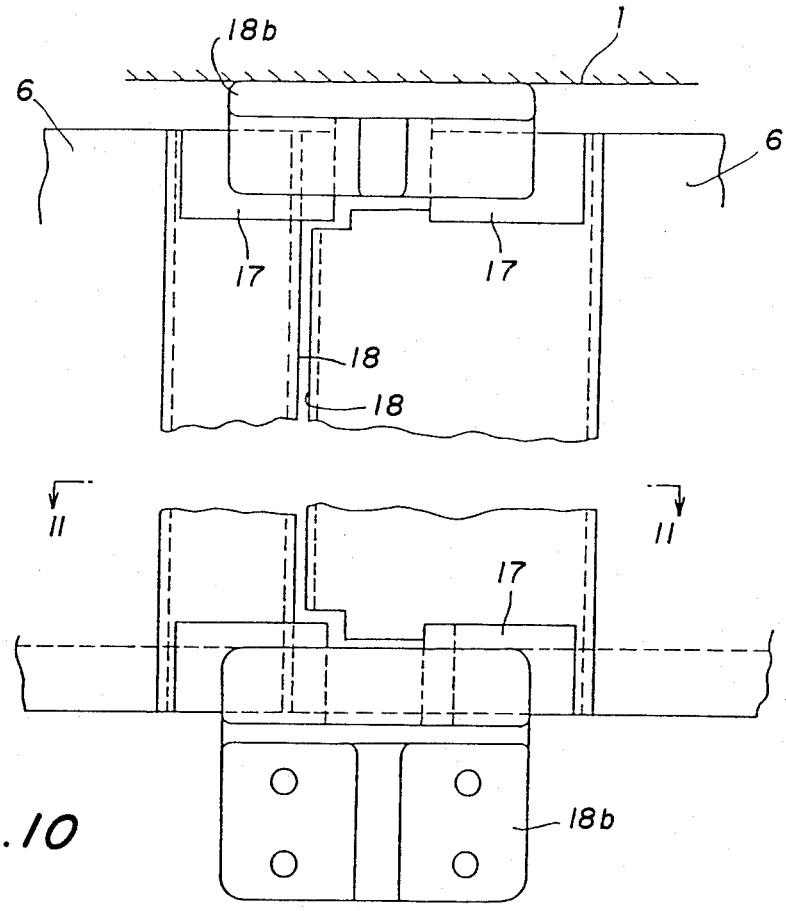
FIG. 10 is a side view of the upper and lower sliding door stoppers at the center of the sliding door.

FIG. 10 shows the relationship between the stopper 17 installed adjacent the pull-to-close side 18 of the door 6 (FIG. 3a) and a stopper receiver 18b at substantially the center of the opening of the car. In this embodiment, the stoppers 17 and stopper receivers 18b are provided on the top edge and the bottom edge of each sliding door. This is for effective use of the opening of the car when the right-hand side and the left-hand side sliding doors 6 are opened. When a center post or a wall (not illustrated) is present between the left-hand side and the right-hand side sliding doors, stoppers 17 and stopper receivers 18b may be provided at appropriate positions on the post or the wall or over the full length.

Figure 11:
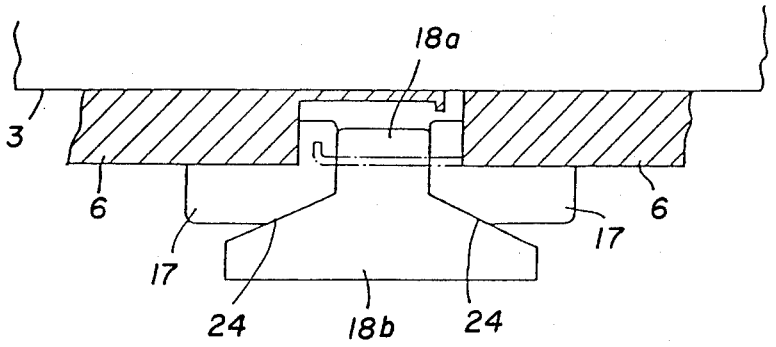
FIG. 11 is a sectional view of the lower sliding door stopper taken on the line 11—11 of FIG. 10.

FIG. 11 shows an end view of the stoppers 17 of the two doors and the stopper receiver 18b at the bottom of the door, which is similar to the arrangement at the top. Their contact is between a sloped face 24 and the convex protrusion 18a of the stopper receiver 18b. The use of the sloped faces 24 allows for smooth introduction of the sliding doors 6 moving according to the configurations of the upper and the lower rails when the sliding doors are being closed. When a force is exerted on the sliding doors from the inside due to displacement of the cargo, etc., these sloped faces 24 will bear the force to prevent the sliding doors 6 from coming off the rails. On the other hand, the convex protrusion 18a of the stopper receiver 18b is arranged to hold the sliding doors fixed and to bear the longitudinal shocks generated when vehicles are coupled together.

Figure 12:
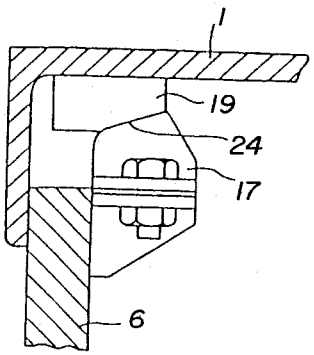
FIG. 12 is a sectional view of the upper sliding door stopper for preventing lift-up of the door.

FIG. 12 shows the relationship between a stopper 17 mounted on the top of a sliding door and a stopper receiver 19 mounted on the car part 1. The stopper 17 and the stopper receiver 19 have sloped faces 24 similar to the above-mentioned stopper receiver 18*b*, and the adoption of this slope allows for easy pushing-in and withdrawal of the sliding doors 6 and also prevents the sliding doors 6 from vibrating up and down during movement of the vehicle, which could lead to an accident. In this embodiment, stoppers 17 and associated stopper receivers are provided at three points for each sliding door. The numbers or their ranges of installation can be increased or expanded as required. In FIG. 10 through FIG. 12, the relationship of the stoppers and stopper receivers is merely provided for ease of introduction and prevention of vertical movement. As for the pushing-in of the sliding doors, the sliding doors 6 and the convex protrusions 18*a* of the stopper receivers, or the sliding doors 6 and the side sill 3 or the head jamb 1, are arranged to come into direct contact with each other. It is possible, however, to adopt an arrangement in which the sliding doors 6 do not directly contact the head jamb 1 or the side sill 3. Instead, they may have indirect contact through the sloped faces 24, and the wedging action of the sloped faces is used to push in the sliding doors 6. In this case, the stoppers 17 and the stopper receivers 19 may be provided on either upper or lower portions of the sliding doors or on one side only, with similar effects.

Figure 13:
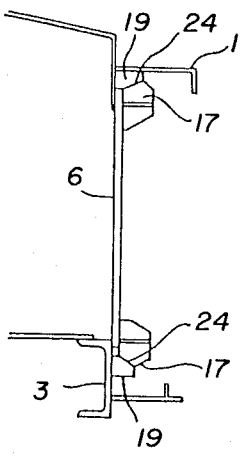
FIG. 13 is a cross-sectional view showing the installation of the stoppers of FIG. 12.

FIG. 13 shows the installation on both upper and lower portions, and as explained above, which securely holds the sliding doors.

Figure 14B:
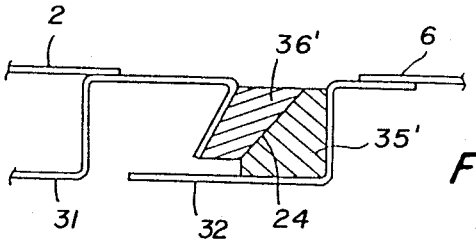
FIGS. 14*a* and 14*b* are sectional views of two alternate constructions of the inlet post and the outer sliding door edge arrangements, taken along the line 14*a*—14*a* of FIG. 1.
Figure 14A:
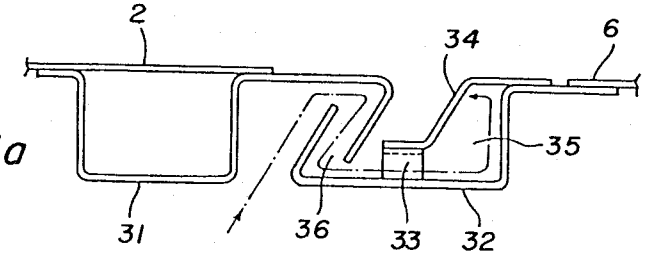

FIGS. 14*a* and 14*b* show the coupling between a sliding door 6 and a fixed wall 2 of the vehicle, and FIG. 14*a* shows the coupling due to a labyrinth effect. Between the outer edge frame 32 of the sliding door 6 and the inlet post 31 of the fixed wall 2 at the location of the edge frame 32 when the door is closed, a gap 36 is formed by the edge frame 32 covering or surrounding an edge of the inlet post 31 within. The parts are arranged not to prevent the pushing-in or the withdrawal of the sliding door. At the inner side of the inlet post 31, a coupling plate 34 supported by a coupling plate holder 33 is provided over the edge frame 32 of the sliding door 6 to form a relatively large space 35 between the coupling plate 34 and the edge frame 32. This space 35 is larger than the gap 36, and as shown by the dash-dot line in FIG. 14*a*, it exhibits the so-called labyrinth effect, which gathers incoming rainwater into the space 35, without allowing it to enter the vehicle, and drain it off downwardly to prevent intrusion of the rainwater. FIG. 14(*b*) shows another embodiment of this coupling, which uses sealing members 35' and 36' made of rubber or similar elastic seal material rather than the labyrinth effect and achieves reliable coupling by the wedging action with elastic deformation.

Figure 15B:
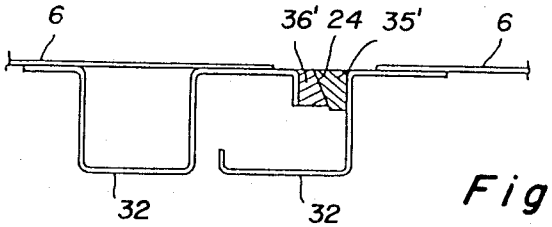
FIGS. 15*a* and 15*b* are sectional views of two alternate constructions of the centers of the sliding doors, taken along the line 15*a*—15*a* of FIG. 1.
Figure 15A:
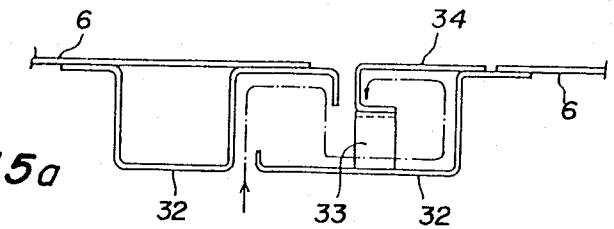

FIGS. 15*a* and 15*b* show coupling arrangements between two sliding doors 6 which have been moved together. FIG. 15*a* shows an arrangement using the labyrinth effect, and its effect is similar to the arrangement shown in FIG. 14*a*. FIG. 15*b* shows a coupling system which uses two sealing members 35' and 36' similar to the arrangement of FIG. 14*b*. As the sliding doors are brought to contact with each other, the sloped faces 24 have a relatively small angle.

The merits of the present invention are as follows:

(1) A push-in type sliding door apparatus wherein the structure is simpler than the prior art constructions can be realized;

(2) A reliable push-in mechanism which can be operated by a single operator is provided;

(3) An effective car opening larger than those of the prior art can be obtained;

(4) Sliding doors can be prevented from lifting up by the use of stoppers having a simple construction, and a reliable closure can be obtained; and (5) A reliable locking mechanism utilizing its own weight can be realized.

A door may be readily moved by a single operator from the open to the closed position by the following sequence. The operator grasps the handle 28 of the left-hand door 6 (FIG. 1), for example, and pushes the door toward the right, the handle bar 15 being displaced upwardly against the stop 27 and the shafts 11 being disengaged from the strikes. The lower rollers 7 roll along the rail 5, and the innermost roller 7, which is adjacent the inner side edge 18 of the door moves across the junction 53 and remains on the main rail 5. This occurs because the large flange of this innermost roller is on the outside and engages the laterally outer surface of the raised portion 55 of the junction 53. When the innermost roller 7 reaches the curved rail point 52, this side edge 18 starts to move laterally into the door opening formed in the side 2. At this time, the outermost roller 7, which is adjacent the other side edge of the door 6, is at the junction 53, and the shafts 11 are generally aligned with the strikes 13. The operator then pulls downwardly on the handle bar 15, causing the sloped surfaces 12*a* to engage the edges 14*a* of the strikes 14. This action wedges or cams the outermost side edge of the door 6 laterally inwardly into the door opening, and the outermost roller 7 rolls onto the branch rail 51. The operator may assist this action by pushing the door laterally inwardly and pulling the door along the curved points 51 and 52. The handle 15 moves into the lock mechanism 20 which secures the door in the closed position. The door is, of course, opened by following the reverse procedure. The flanged lower rollers 7 cooperate with the curved points 51 and 52 and the junction to move the lower edge of the door laterally as described, and the upper rollers 8 and the upper rails 4 perform the same function. The auxiliary upper roller 9 prevents the innermost upper roller 8 from moving into the point 41.

What is claimed is:

1. A push-in type sliding door apparatus for a vehicle having a fixed side wall with a door opening therein, an upper rail and a lower rail fixed on said side wall and extending adjacent said opening, each of said rails having a linear portion which extends in parallel to said side wall and is laterally outwardly spaced from said side wall, a curved portion extending from one end of said linear portion generally toward said side wall, and a branch rail at an intermediate point of said linear portion and extending between said linear portion and said side wall generally in the same direction as that of said curved portion, at least one sliding door, at least two upper rollers provided on the upper portion of said sliding door and adapted to be engaged with said linear portion of the upper rail, one of said upper rollers being adapted to engage said curved portion of the upper rail and the other upper roller being adapted to engage said branch rail of the upper rail when said door is closed, at least two lower rollers provided on the lower portion of said door and adapted to be engaged with said linear portion of the lower rail, one of said lower rollers being adapted to engage said curved portion of the lower rail and the other lower roller being adapted to engage said branch rail of the lower rail when said door is closed, said apparatus comprising a push-in mechanism provided on said door adjacent one side, and strikes adapted to be mounted on the upper and lower portions of the fixed side wall adjacent said one side, said push-in mechanism including a handle bar pivotally mounted on said door for swinging movement in a plane which is substantially parallel to the plane of said door, lock shafts slidably mounted on said door substantially in said plane of said handle bar and linked to said handle bar for movement of said lock shafts upon pivotal movement of said handle bar, said strikes and said lock shafts having cooperating wedging means thereon, whereby a pushing-in force is generated on the door toward said side wall by the wedging action of said lock shafts and strikes when said door is substantially closed and the handle bar is pivoted.

2. A push-in type sliding door apparatus according to claim 1, wherein said wedging means comprises a slope provided on one of said lock shafts and said strikes, and said pushing-in force is generated by the wedging action of said slope.

3. A push-in type sliding door apparatus according to claim 1 or claim 2, wherein stoppers are provided on the upper portion and on the opposite side of the sliding door.

4. A push-in type sliding door apparatus according to claim 1 or claim 2, wherein a coupling is formed between at least one edge of said door and an adjacent part, said coupling comprising sealing members having contact faces, said contact faces of said sealing members being sloped and one sealing member being forced against the other sealing member to effect coupling therebetween.

5. A push-in type sliding door apparatus according to claim 1 or claim 2, wherein a relatively small gap is maintained between said door and an adjacent part and a space larger than said small gap is maintained between the outer side of said door and the inner side of said part to effect coupling.

6. A push-in type sliding door apparatus according to claim 1, wherein a horizontal door roller is mounted adjacent the upper portion of said door and a flanged vertical door roller is mounted adjacent the lower portion of said door, the vertical clearance between said horizontal door roller and said upper rail being smaller than the flange height of said vertical door roller.

7. A push-in type sliding door apparatus according to claim 1, and further including a handle bar receiver mounted on said door adjacent said handle, said receiver having an opening therein and a rotatable lock for closing said opening, said handle bar being movable by gravity into the opening of said handle bar receiver, and said rotatable lock being rotated by the handle bar to open said opening only when the handle bar moves into the handle bar receiver.

8. In a railway car including a side wall, a door opening formed in said side wall, an upper rail on said wall adjacent the upper portion of said opening and a lower rail on said side wall adjacent the lower portion of said opening, a door mounted for movement on said rails and movable between open and closed positions relative to said opening, the improvement of lower rollers adjacent the bottom of said door for supporting said door on said lower rail, upper rollers adjacent the top of said door for engagement with said upper rail, said rails having curved portions enabling said door to be pushed into said opening, a handle bar pivotably mounted on said door for swinging movement in a plane which is substantially parallel to and spaced from said door, a lock shaft slidably mounted on said door for movement substantially in said plane and linked to said handle, a strike mounted on the side wall adjacent the lock shaft when said door is in said closed position, said swinging movement of said handle bar causing said lock shaft to move into said strike, and said shaft and said strike having cooperating wedging means thereon for forcing said door laterally into said opening as said shaft is moved into said strike.

9. Apparatus according to claim 8, wherein said wedging means comprises a slanted surface.

10. Apparatus according to claim 8, wherein said upper and lower rails are curved adjacent one end thereof for moving one edge portion of said door laterally into said door opening, and said lock shaft and said strike being located adjacent the opposite edge portion of said door and move said opposite edge portion into said door opening.

11. Apparatus according to claim 1, wherein said lock shafts are moved generally vertically when said handle bar is pivoted downwardly to generate said pushing-in force and the weights of said handle bar and said lock shafts assist said downward pivotal movement of said handle bar.

12. Apparatus according to claim 1, and further including stop means on said door, stop receiver means on said side wall adjacent said opening and cooperating with said stop means when said door is closed to hold said door closed, and a labyrinth seal on said door and said wall when said door is closed.

13. Appartus according to claim 8, wherein said lock shaft is moved generally vertically when said handle bar is pivoted downwardly to generate said pushing-in force and the weights of said handle bar and said lock shaft assist said downward pivotal movement of said handle bar.

14. Apparatus according claim 8, and further including stop means on said door, stop receiver means on said side wall adjacent said opening and cooperating with said stop means when said door is closed to hold said door closed, and a labyrinth seal on said door and said wall when said door is closed.

* * * * *